US006862009B2

(12) United States Patent
Park

(10) Patent No.: US 6,862,009 B2
(45) Date of Patent: Mar. 1, 2005

(54) PLASMA DISPLAY PANEL AND METHOD FOR DRIVING THE SAME

(75) Inventor: Jung-Pil Park, Cheonan (KR)

(73) Assignee: Samsung SDI Co., Ltd., Suwon (KR)

( * ) Notice: Subject to any disclaimer, the term of this patent is extended or adjusted under 35 U.S.C. 154(b) by 292 days.

(21) Appl. No.: 10/251,607

(22) Filed: Sep. 20, 2002

(65) Prior Publication Data

US 2003/0071768 A1 Apr. 17, 2003

(30) Foreign Application Priority Data

Oct. 15, 2001 (KR) ..... 01-063454

(51) Int. Cl.[7] ..... G09G 3/28

(52) U.S. Cl. ..... 345/67; 345/60; 345/66; 345/68; 315/169.1; 315/169.2; 315/169.3; 315/169.4

(58) Field of Search ..... 345/60, 66, 67, 345/68; 315/169.1, 169.2, 169.3, 169.4

(56) References Cited

U.S. PATENT DOCUMENTS 4,866,349 A 9/1989 Weber et al.
5,081,400 A 1/1992 Weber et al.
6,140,984 A * 10/2000 Kanazawa et al. ..... 345/67
RE37,083 E * 3/2001 Kanazawa ..... 315/169.4

FOREIGN PATENT DOCUMENTS

JP 2003-0003573 1/2003

OTHER PUBLICATIONS

Korean Patent Abstracts(KR) for Publication No. 102003003573; Publication Date Jan. 10, 2003.

* cited by examiner

*Primary Examiner*—Bipin Shalwala
*Assistant Examiner*—Vincent E. Kovalick
(74) *Attorney, Agent, or Firm*—Christie, Parker and Hale, LLP

(57) ABSTRACT

An apparatus for driving a plasma display panel (PDP). The PDP includes a sustain discharge unit, a first charge and discharge unit, and a second charge and discharge unit. The sustain discharge unit maintains a voltage of a terminal of the panel capacitor at the sustain discharge voltage or the ground voltage. The first charge and discharge unit charges one end of the panel capacitor to the sustain discharge voltage or discharges one end of the panel capacitor to the ground voltage. The second charge and discharge unit charges the other end of the panel capacitor to the sustain discharge voltage or discharges the other end of the panel capacitor to the ground voltage.

13 Claims, 6 Drawing Sheets

<First mode>

<Second mode>

<Third mode>

<Fourth mode>

PLASMA DISPLAY PANEL AND METHOD FOR DRIVING THE SAME

CROSS-REFERENCE TO RELATED APPLICATIONS

This application claims priority to and the benefit of Korean Patent Application No. 2001-0063454 filed on Oct. 15, 2001.

BACKGROUND OF THE INVENTION (a) Field of the Invention

The present invention relates to a plasma display panel (PDP) and a method for driving the same. More specifically, the present invention relates to a sustain discharge circuit that directly distributes the light emission of the PDP and a method for driving the same.

(b) Description of the Related Art

A flat panel display such as a liquid crystal display (LCD), a field emission display (FED), and a plasma display panel (PDP) has recently been actively developed. Among the flat panel displays, the PDP has brightness and luminous efficiency that are higher than those of the other flat panel displays, and a viewing angle wider than those of the other flat panel displays. Therefore, the PDP is spotlighted as a display that can replace a conventional cathode ray tube (CRT) in a more than 40-inch large display.

The PDP is a flat panel display for displaying characters or images using plasma generated by gas discharge. Pixels ranging from hundreds of thousands to more than millions are arranged in the form of a matrix according to the size of the PDP. PDPs are divided into a direct current (DC) PDP and an alternating current (AC) PDP according to the shape of the waveform of an applied driving voltage and the structure of a discharge cell.

Current directly flows in discharge spaces while a voltage is applied in the DC PDP, because electrodes are exposed to the discharge spaces. Therefore, a resistor for restricting the current must be used outside of the DC PDP. On the other hand, in the case of the AC PDP, the current is restricted due to the natural formation of a capacitance component because a dielectric layer covers the electrodes. The AC PDP has a longer life than the DC PDP because the electrodes are protected against the shock caused by ions during discharge.

FIG. 1 is a partial perspective view of an AC PDP.

As shown in FIG. 1, scan electrodes 4 and sustain electrodes 5 that make pairs and are covered with dielectric layer 2 and protecting film 3 are formed to be parallel to each other on first glass substrate 1. A plurality of address electrodes 8 covered with dielectric layer 7 are installed on second glass substrate 6. Barrier ribs 9 are formed to be parallel to address electrodes 8 on dielectric layer 7 between address electrodes 8. Phosphor 10 is formed on the surface of dielectric layer 7 and on both sides of barrier ribs 9. First glass substrate 1 and second glass substrate 6 are arranged to face each other interposing discharge spaces 11 between first glass substrate 1 and second glass substrate 6, so that scan electrodes 4 and sustain electrodes 5 that make pairs cross address electrodes 8. The discharge space positioned where scan electrode 4 and sustain electrode 5 that make a pair cross address electrodes 8 forms discharge cell 12.

FIG. 2 shows the arrangement of the electrodes of the PDP.

As shown in FIG. 2, the PDP electrodes have an m×n matrix structure. To be specific, address electrodes A1 through Am are arranged in a column direction, and n row sustain electrodes X1 through Xn and scan electrodes Y1 through Yn are arranged in a zigzag pattern in a row direction. The discharge cell shown in FIG. 2 corresponds to discharge cell 12 shown in FIG. 1.

In general, a method for driving the AC PDP includes a reset (initializing) period, a write (addressing) period, a sustain period, and an erase period.

In the reset period, the states of the respective cells are initialized in order to smoothly address the cells. In the write period, the cells that are turned on and the cells that are turned off are selected, and wall charges are accumulated on the cells that are turned on (the addressed cells). In the sustain period, discharge is performed in order to actually display pictures on the addressed cells. In the erase period, the wall charge of the cells is reduced, to thus terminate sustain discharge.

In the AC PDP, because the scan electrodes (Y electrodes) and the sustain electrodes (X electrodes) for performing sustain discharging of the AC PDP operate as capacitive load, capacitance between the scan electrodes and the sustain electrodes exists. Reactive power other than power for discharge is necessary in order to apply waveforms for the sustain discharge. A circuit for recovering and refusing the reactive power is referred to as a sustain discharge circuit or an energy recovery circuit.

The sustain discharge circuit of a conventional AC PDP and a method for driving the same will now be described.

FIGS. 3 and 4 show a conventional sustain discharge circuit and the operational waveforms of the conventional sustain discharge circuit.

The sustain discharge circuit suggested by L. F. Weber and disclosed in U.S. Pat. Nos. 4,866,349 and 5,081,400 is the sustain discharge circuit or the energy recovery circuit of the AC PDP. In the driving circuit of the AC PDP, sustain discharge circuit 10 of the X electrodes has the same structure as that of sustain discharge circuit 11 (not shown) of the Y electrodes. The sustain discharge circuit of the X electrodes will now be described for convenience' sake.

The conventional sustain discharge circuit 10 includes an energy recovery unit having two switches Sa and Sb, two diodes D1 and D2, inductor Lc, energy recovery capacitor Cc, and a sustain discharge unit having two switches Sc and Sd.

The panel is connected to a contact point between two switches Sc and Sd. The panel is depicted as equivalent capacitor Cp.

The conventional sustain discharge circuit having the above structure operates in four modes according to the switching operations of switches Sa through Sd, as shown in FIG. 4. The waveforms of current $I_L$ that flows through inductor Lc and output voltage Vp are respectively shown according to the switching operations.

In an initial stage, the voltage of both ends of the panel is maintained at 0 V because switch Sd is turned on immediately before switch Sa is turned on. At this time, energy recovery capacitor Cc is previously charged by voltage Vs/2 that is half of sustain discharge voltage Vs, so that a rush current is not generated when the sustain discharge starts.

In a state where voltage Vp of both ends of the panel is maintained at 0 V, at the point of time t0, the operation of mode 1 starts when switch Sa is turned on and switches Sb, Sc, and Sd are turned off.

In the operation periods between t0 and t1 of mode 1, an LC resonance circuit is formed with a current path of switch Sa, diode D1, inductor Lc, and plasma panel capacitor Cp. Therefore, as shown in FIG. 4, current $I_L$ that flows through inductor Lc forms a half wave due to LC resonance, and output voltage Vp of the panel slowly increases and becomes almost sustain discharge voltage Vs. The current scarcely flows through inductor Lc at the point of time where output voltage Vp of the panel becomes sustain discharge voltage Vs.

When mode 1 is completed, mode 2 starts when switches Sa and Sc are turned on and switches Sb and Sd are turned off. In the operation period between t1 and t2 of mode 2, external applied voltage Vs is directed through panel capacitor Cp through switch Sc to thus maintain output voltage Vp of the panel. At this time, zero-voltage switching is performed at t1 because the voltage of both ends of switch Sc is ideally 0.

When mode 2 is completed in a state where the discharge of output voltage Vp of the panel is maintained, mode 3 starts when switch Sb is turned on and switches Sa, Sb, and Sc are turned off.

In the operation period between t2 and t3 of mode 3, the LC resonance circuit is formed with a current path reverse to that in mode 1, that is, with the current path of plasma panel capacitor Cp, inductor Lc, diode D2, switch Sb, and energy recovery capacitor Cc. Accordingly, as shown in FIG. 4, current $I_L$ flows through inductor Lc and output voltage Vp of the panel decreases. Therefore, current $I_L$ of inductor Lc and output voltage Vp of the panel become 0 at the point of time t3.

In the operation period between t3 and t4 of mode 4, switches Sb and Sd are turned on and switches Sa and Sc are turned off. Accordingly, output voltage Vp of the panel is maintained at 0 V. When switch Sa is turned on again in this state, the process returns to the operation of mode 1. Accordingly, the operations are repeated.

In the conventional sustain discharge circuit, it is not possible for the switches to perform the zero-voltage switching due to the parasitic components of the actual circuit such as the parasitic resistance of the inductor, the parasitic resistances of the capacitor and the panel, and the conductance resistance of the switch. Accordingly, switching loss significantly increases when the switches are turned on. That is, according to the conventional sustain discharge circuit, the magnetic energy stored in inductor Lc is 0 when one terminal of the panel capacitor ideally increases to sustain discharge voltage Vs. Therefore, when the one terminal of the panel capacitor does not increase to sustain discharge voltage Vs due to the parasitic components of the actual circuit, a voltage source for increasing the voltage of the one terminal of the panel capacitor to sustain discharge voltage Vs does not exist. Therefore, it is not possible for actual switch Sc to perform the zero-voltage switching. Accordingly, the switching loss significantly increases when the switches are turned on.

Also, in the conventional sustain discharge circuit, the energy recovery capacitor Cc must always be previously charged to voltage Vs/2 right after the light emission starts. In a state where the energy recovery capacitor is not charged to voltage Vs/2, a significantly large rush current is generated when a sustain discharge pulse starts. Therefore, a protecting circuit for restricting the rush current must be additionally included.

SUMMARY OF THE INVENTION

In accordance with the present invention an apparatus and a method for driving a plasma display panel (PDP) is provided which is capable of performing zero-voltage switching in spite of the parasitic components of an actual circuit.

Further in accordance with the present invention an apparatus and a method for driving the PDP is provided which is capable of removing a rush current when a sustain discharge operation starts.

In one aspect of the present invention, there is provided an apparatus for driving a plasma display panel (PDP) having a plurality of scan electrodes and sustain electrodes arranged in a zigzag pattern so as to make pairs with each other, and having a panel capacitor between the scan electrodes and the sustain electrodes. The apparatus includes a sustain discharge unit having first and second switches serially connected between a first voltage and a second voltage and having a contact point of the first and second switches coupled to one end of the panel capacitor and third and fourth switches serially connected between the first voltage and the second voltage and having a contact point of the third and fourth switches coupled to the other end of the panel capacitor. The sustain discharge unit maintains a voltage of a terminal of the panel capacitor at the first voltage or the second voltage. The apparatus also includes a first charge and discharge unit having first and second capacitors serially connected between the first voltage and the second voltage and a first inductor coupled to a contact point of the first and second capacitors and one end of the panel capacitor. The first charge and discharge unit charges one end of the panel capacitor to the first voltage or discharges one end of the panel capacitor to the second voltage. The apparatus also includes a second charge and discharge unit having third and fourth capacitors serially connected between the first voltage and the second voltage and a second inductor coupled to a contact point of the third and fourth capacitors and the panel capacitor. The second charge and discharge unit charges the other end of the panel capacitor to the first voltage or discharges the other end of the panel capacitor to the second voltage.

The first charge and discharge unit further includes a fifth switch for switching the current path between the first inductor and the panel capacitor. The second charge and discharge unit further includes a sixth switch for switching the current path between the second inductor and the panel capacitor.

In another aspect of the present invention, there is provided a method for driving a PDP. Second and fourth switches are turned on to thus maintain voltages of one end and the other end of a panel capacitor at a first voltage. A fifth switch is turned on and the second switch is turned off to thus increase the voltage of one end of the panel capacitor to a second voltage. The first switch is turned on when the voltage of one end of the panel capacitor increases to the second voltage to thus maintain the voltages of one end and the other end of the panel capacitor at the first voltage and the second voltage, respectively. The first switch is turned off to thus decrease the voltage of one end of the panel capacitor to the second voltage. The second switch is turned on when the voltage of one end of the panel capacitor reaches the second voltage to thus maintain the voltage of one end of the panel capacitor at the second voltage.

In another aspect of the present invention, there is provided a PDP having a panel comprising a plurality of address electrodes and a plurality of scan electrodes and sustain electrodes crossing the address electrodes and arranged in a zigzag pattern so as to make pairs with each other. A panel capacitor exists between the scan electrodes and the sustain electrodes. A controller receives a video signal from the outside and generates an address drive control signal and a sustain discharge signal. An address driver receives the address drive control signal from the controller and applies a display data signal for selecting discharge cells to be displayed to the address electrodes. A scan and sustain driver receives the sustain discharge signal from the controller and alternately inputs a sustain discharge voltage to the scan electrodes and the sustain electrodes to thus perform sustain discharge of the selected discharge cells.

The scan and sustain driver includes a sustain discharge unit having first and second switches serially connected between a first voltage and a second voltage and having a contact point coupled to one end of the panel capacitor and third and fourth switches serially connected between the first voltage and the second voltage and having a contact point coupled to the other end of the panel capacitor. The sustain discharge unit maintains a voltage of a terminal of the panel capacitor at the first voltage or the second voltage. A first charge and discharge unit has first and second capacitors serially connected between the first voltage and the second voltage and a first inductor coupled to a contact point of the first and second capacitors and one end of the panel capacitor. The first charge and discharge unit charges one end of the panel capacitor to the first voltage or discharges one end of the panel capacitor to the second voltage. A second charge and discharge unit has third and fourth capacitors serially connected between the first voltage and the second voltage and a second inductor coupled to a contact point of the third and fourth capacitors and the other end of the panel capacitor. The second charge and discharge unit charges the other end of the panel capacitor to the first voltage or discharges the other end of the panel capacitor to the second voltage.

DETAILED DESCRIPTION OF EMBODIMENTS OF THE INVENTION

Figure 1:
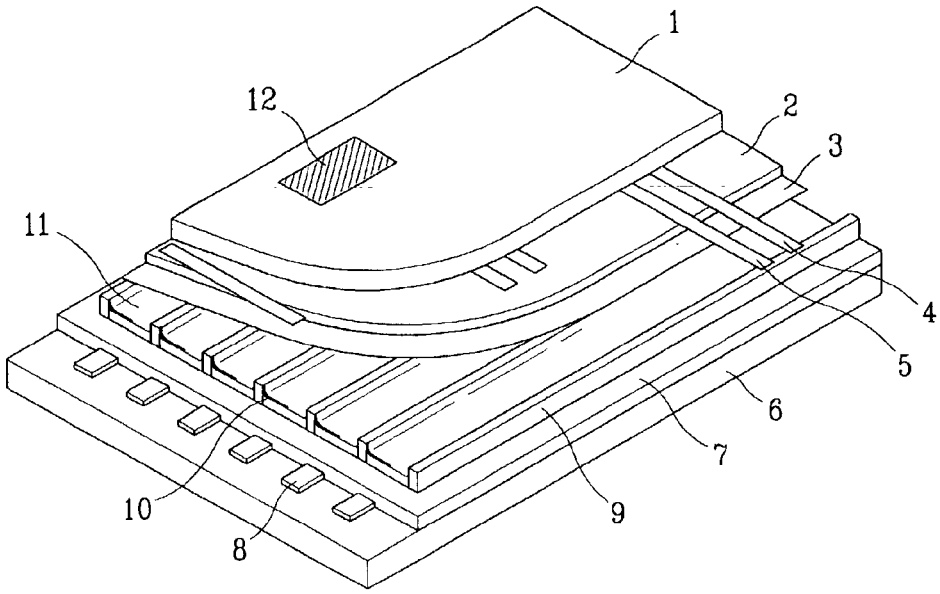
FIG. 1 is a partial perspective view of an alternating current plasma display panel (AC PDP).
Figure 2:
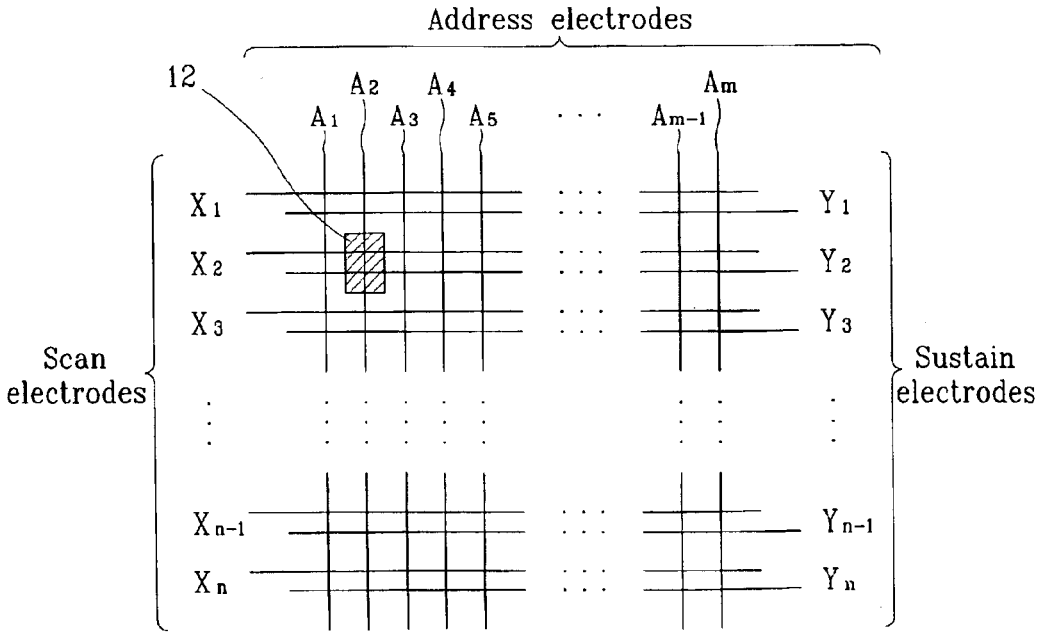
FIG. 2 shows the arrangement of the electrodes of a PDP.
Figure 3:
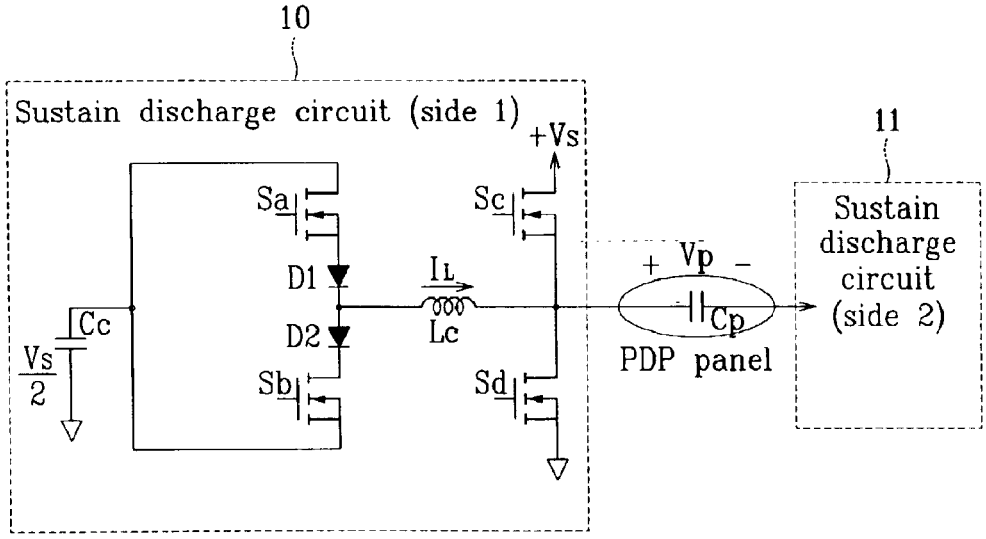
FIG.3(Prior Art)
FIGS. 3 and 4 show a conventional sustain discharge circuit and the driving waveforms of the conventional sustain discharge circuit, respectively.
Figure 4:
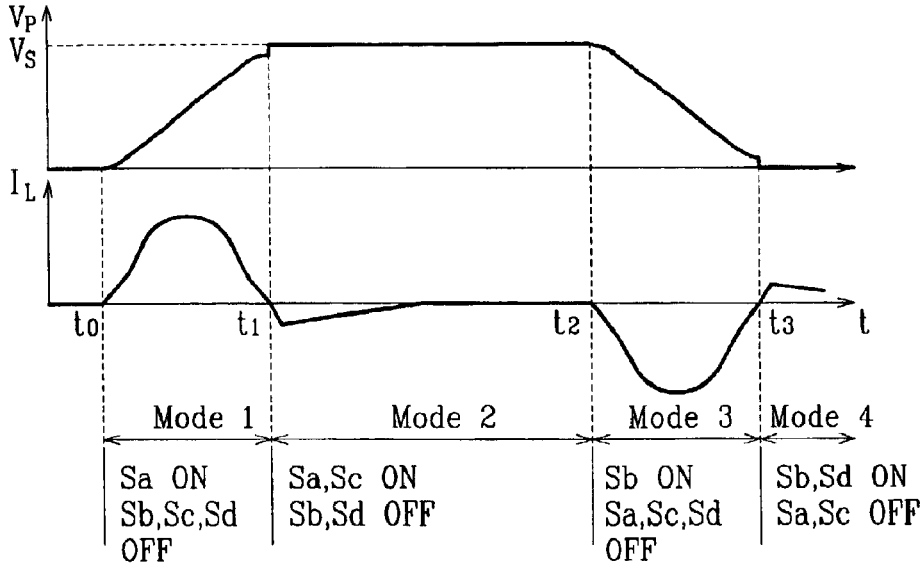
FIG.4(Prior Art)
Figure 5:
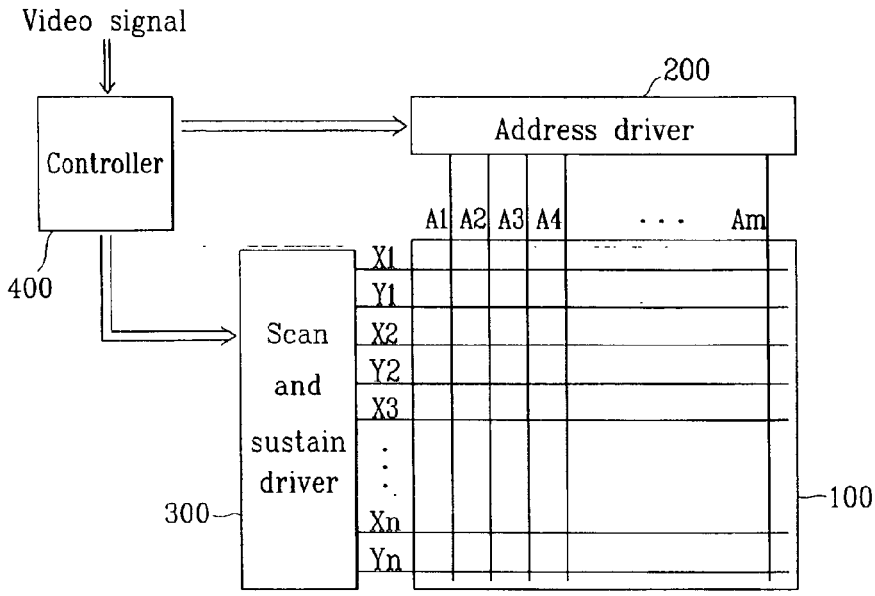
FIG. 5 shows a PDP according to an embodiment of the present invention.

FIG. 5 shows a plasma display panel (PDP) according to an embodiment of the present invention.

As shown in FIG. 5, the PDP according to the embodiment of the present invention includes plasma panel 100, address driver 200, scan and sustain driver 300, and controller 400.

Plasma panel 100 includes a plurality of address electrodes A1 through Am arranged in a column direction and a plurality of scan electrodes X1 through Xn and sustain electrodes Y1 through Yn arranged in a zigzag pattern in a row direction.

Address driver 200 receives an address drive control signal from controller 400 and applies a display data signal for selecting discharge cells to be displayed to the respective address electrodes.

Scan and sustain driver 300 receives a sustain discharge signal from controller 400 and alternately inputs a sustain pulse voltage to scan electrodes and sustain electrodes, to thus perform sustain discharge of the selected discharge cells.

Controller 400 receives a video signal from the outside, generates the address drive control signal and the sustain discharge signal, and applies the address drive control signal and the sustain discharge signal to address driver 200 and scan and sustain driver 300, respectively.

Figure 6:
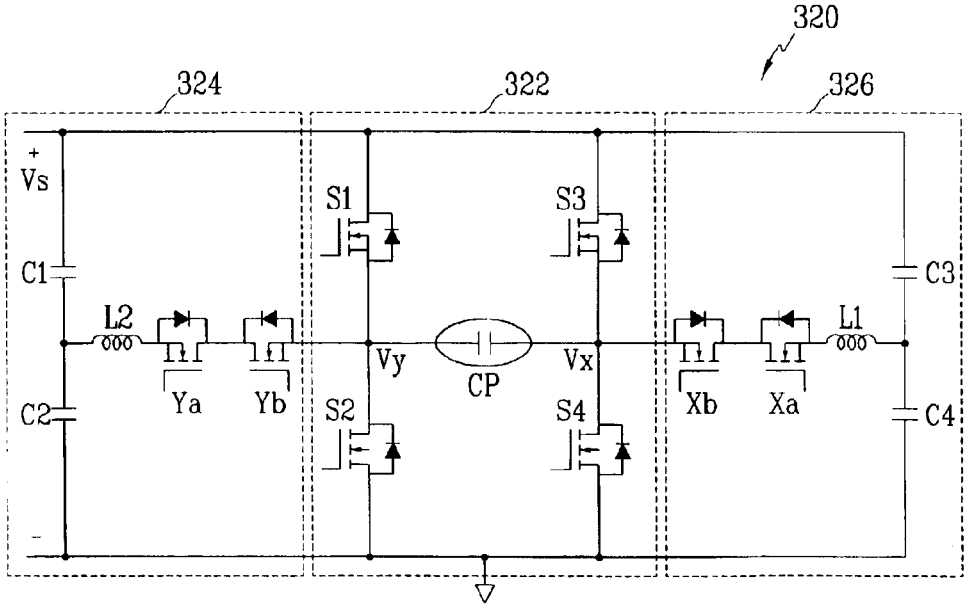
FIG. 6 shows a sustain discharge circuit according to the embodiment of the present invention.

Scan and sustain driver 300 according to the embodiment of the present invention includes sustain discharge circuit 320 shown in FIG. 6 for recovering and re-using reactive power.

As shown in FIG. 6, sustain discharge circuit 320 according to the embodiment of the present invention includes sustain discharge unit 322, Y electrode charge and discharge unit 324, and X electrode charge and discharge unit 326.

Sustain discharge unit 322 includes four transistors S1, S2, S3, and S4 which are connected to sustain discharge voltage Vs or a ground voltage respectively, each of which has a body diode. Voltages Vy and Vx of both terminals of a panel capacitor maintain sustain discharge voltage Vs or the ground voltage by the switching operation of the four transistors.

Y electrode charge and discharge unit 324 includes capacitors C1 and C2 serially connected between sustain discharge voltage Vs and the ground voltage, inductor L2 that has one end connected to a contact point between capacitors C1 and C2, and back-to-back switches Ya and Yb connected to the other end of inductor L2 and the terminal of the Y electrode of the panel capacitor. Each of the back-to-back switches Ya and Yb has a body diode. Back-to-back switches Ya and Yb are formed of transistors, where the cathodes or the anodes of the body diodes are connected to each other. Y electrode charge and discharge unit 324 charges the terminal of the Y electrode of the panel capacitor by sustain discharge voltage Vs, and discharges the terminal of the Y electrode of the panel capacitor by the ground voltage.

X electrode charge and discharge unit 326 includes capacitors C3 and C4 serially connected between sustain discharge voltage Vs and the ground voltage, inductor L1 that has one end connected to a contact point between capacitors C3 and C4, and back-to-back switches Xa and Xb connected to the other end of inductor L1 and the terminal of the X electrode of the panel capacitor. Back-to-back switches Xa and Xb are formed of transistors, where the cathodes or the anodes of the body diodes are connected to each other. X electrode charge and discharge unit 326 charges the terminal of the X electrode of the panel capacitor by sustain discharge voltage Vs and discharges the terminal of the X electrode of the panel capacitor by the ground voltage.

The back-to-back switches of Y electrode charge and discharge unit 324 and X electrode charge and discharge unit 326 are turned off in a reset period, an addressing period, and an erase period, and maintain the voltages of capacitors C1, C2, C3, and C4 during the above periods.

A method for driving the PDP according to the embodiment of the present invention will now be described with reference to FIGS. 7 and 8A through 8D.

In the reset period, the addressing period, and the erase period, the back-to-back switches are turned off, to thus maintain the voltages charged to capacitors C1, C2, C3, and C4.

In the sustain period, the back-to-back switches operate in four operation modes according to times, which will now be described. According to the embodiment of the present invention, switches Yb and Xb are always turned on in the sustain period.

1) First mode (between t0 and t1)

Figure 7:
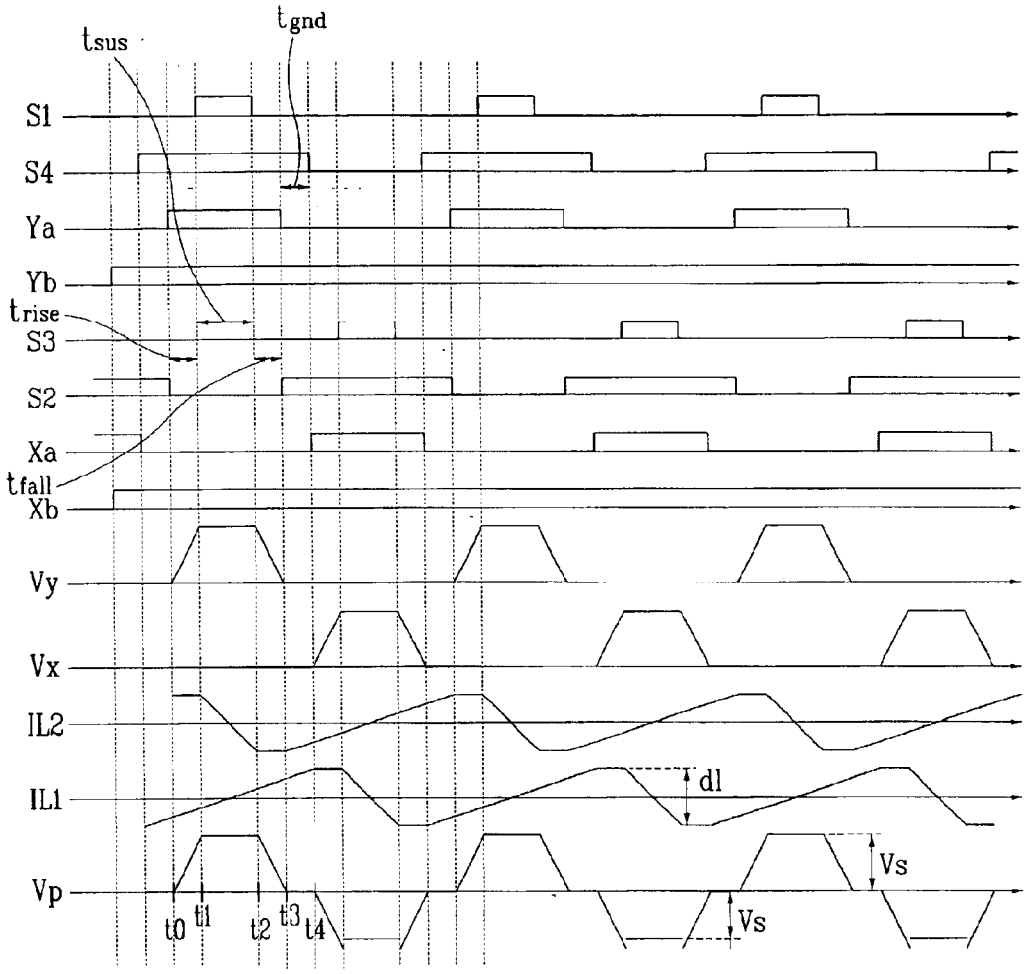
FIG. 7 shows the driving waveforms of the sustain discharge circuit shown in FIG. 6.

When t is earlier than t0, it is assumed that the inductor current of inductor L2 has the maximum value IL2pk, and that switches S2 and S4 are turned on, and that voltages Vy and Vx of both ends of the panel are 0, respectively. Switches S2 and Ya are turned on in the first mode, to thus form a resonance current path of capacitor C2, inductor L2, switch Ya, switch Yb, panel capacitance Cp, and switch S4. Accordingly, voltage Vy of the Y electrode of the panel capacitor and the voltage difference Vp=Vy−Vx between both ends of the panel increase. In the first mode, the charges accumulated into capacitor C2 are applied to the Y electrodes (the scan electrodes) through inductor L2 and the X electrodes (the sustain electrodes) are grounded. In the embodiment of the present invention, capacitors C1 and C2 are designed to be much larger than panel capacitance Cp. Therefore, the ripple of voltages Vc1 and Vc2 of both ends of capacitors C1 and C2 in the first mode is negligible. When t is equal to t1, the voltage of the Y electrode of the capacitor is charged to sustain discharge voltage Vs, that is, the voltages of both ends of the panel are charged to sustain discharge voltage Vs, and the first mode is terminated. According to the embodiment of the present invention, the period of the first mode is very short. Therefore, the panel is linearly charged to almost the maximum value IL2pk of current source IL2 as shown in FIG. 7.

2) Second mode (between t1 and t2)

When t is equal to t1, in the case where voltage Vy becomes sustain discharge voltage Vs, the body diode of switch S1 is turned on. At this time, because switch S1 is turned on in a state where a voltage between the drain and the source of switch S1 is 0 as shown in FIG. 7, that is, because switch S1 performs zero-voltage switching, the turn-on switching loss of switch S1 does not occur. According to the embodiment of the present invention, because enough energy is stored in inductor L2 even at the point of time where the voltage of the Y electrode of the panel capacitor ideally increases to sustain discharge voltage Vs, the voltage of the Y electrode of the panel capacitor can increase to sustain discharge voltage Vs by the energy stored in inductor L2 in an actual case where parasitic components exist in the circuit. In the second mode, sustain discharge voltage Vs is applied to the Y electrodes and the X electrodes are grounded. Accordingly, sustain discharge, that is, display discharge, starts in the discharge cells, where the wall charges are formed, among the discharge cells of plasma panel 100.

Figure 8A:
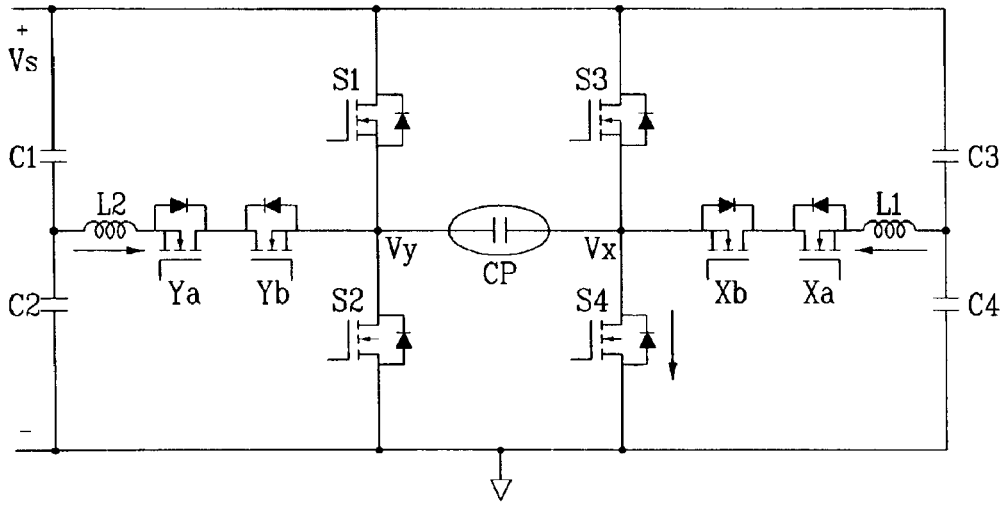
FIGS. 8A and 8D show operation modes according to the embodiment of the present invention, respectively.
Figure 8B:
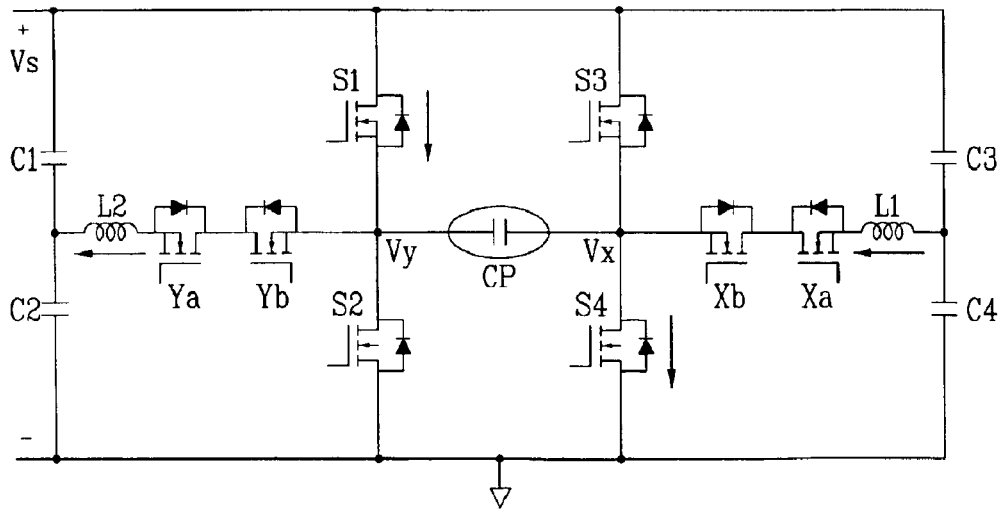
Figure 8C:
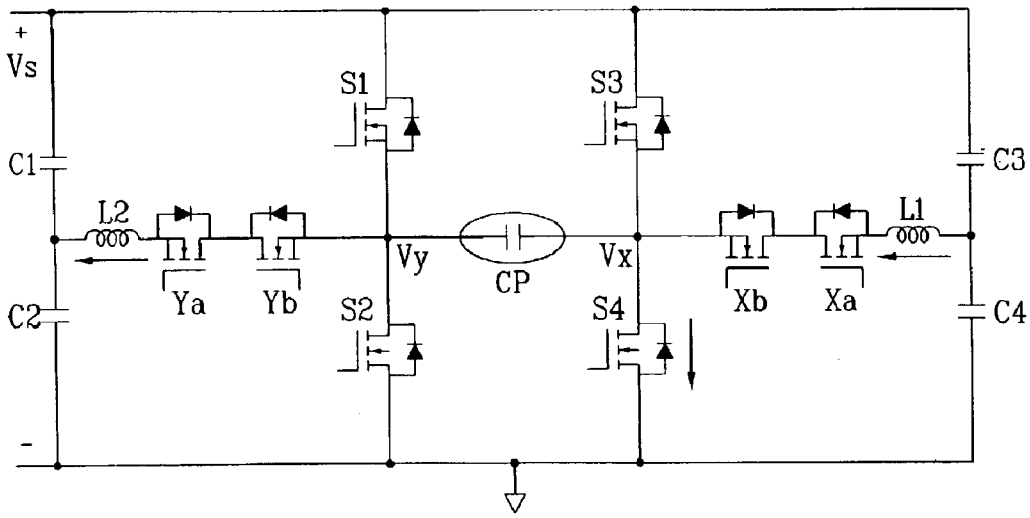
Figure 8D:
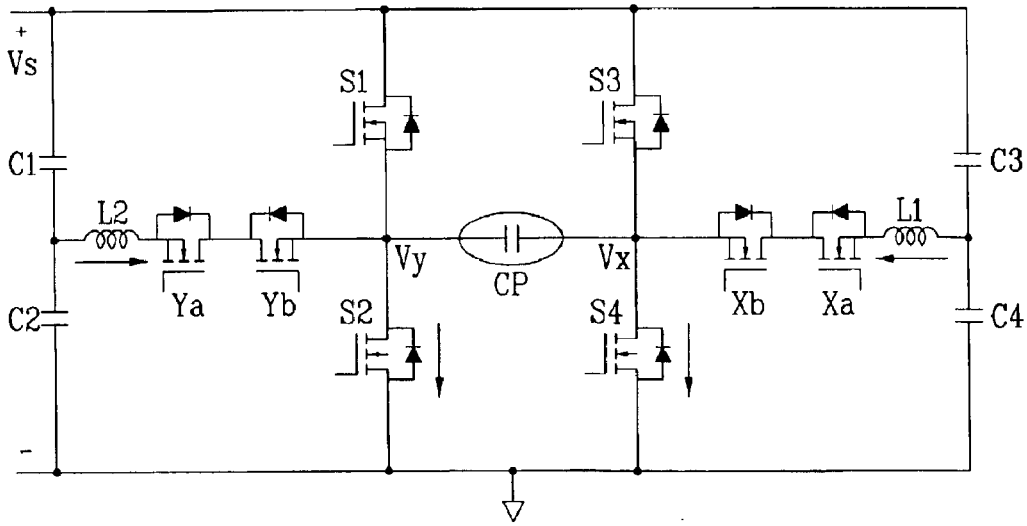

In the second mode, because the voltage of the Y electrode of the panel capacitor is maintained to sustain discharge voltage Vs and the voltage of the X electrode of the panel capacitor is maintained to be grounded, the voltages of both ends of the capacitor of the panel are maintained to be sustain discharge voltage Vs. Therefore, the panel emits light. In the second mode, as shown in FIGS. 7 and 8B, the current flowing with path of capacitor C1, switch S1, and inductor L2 decreases. When t is equal to t2, current IL2 that flows through inductor L2 becomes almost −IL2pk, and switch S1 is turned off. Therefore, the second mode is terminated.

3) Third mode (between t2 and t3)

In the third mode, switch S1 is turned off, to thus form a resonance path of switch S4, panel capacitance Cp, switch Yb, switch Ya, inductor L2, and capacitor C2. Accordingly, voltage Vy of the Y electrode of the panel capacitor decreases. As a result, voltage difference Vp between both ends of the panel decreases. In the third mode, the wall charges that reside around the Y electrodes of the sustain discharged discharge cells are collected in capacitor C2. When t is equal to t3, voltage difference Vp between both ends of the panel becomes 0 and the third mode is terminated. The third mode period is much shorter than the entire switching period. The change value of inductor current IL2 is negligible.

4) Fourth mode (between t3 and t4)

When t is equal to t3, in the case where the voltage of the Y electrode of the panel capacitor becomes 0, the body diode of switch S2 is turned on. At this time, when switch S2 is turned on in a state where a voltage between the drain and the source of switch S2 is 0, the turn-on switching loss does not occur. When t is equal to t4, in the case where IL1 becomes IL1pk and switch S2 is turned off, the fourth mode is terminated and another half period operation starts.

As mentioned above, according to the embodiment of the present invention, even when the parasitic components of the circuit exist, the voltage of the Y electrode or the X electrode of the panel capacitor can be increased to sustain discharge voltage Vs by the energy stored in inductor L2 or L1. Therefore, the zero-voltage switching can be performed when switch S1 or S3 is turned on.

Also, according to the embodiment of the present invention, it is not necessary to previously charge the voltage between capacitors C1 and C2 and capacitors C3 and C4 for recovering power to Vs/2; and it is possible to maintain the voltages of capacitors C1 and C2 and capacitors C3 and C4 by the back-to-back switches in the reset period, the addressing period, and the erase period. Therefore, it is possible to prevent the generation of the rush current when the sustain discharge pulse starts.

While this invention has been described in connection with what is presently considered to be a practical embodiment, it is to be understood that the invention is not limited to the disclosed embodiments, but, on the contrary, is intended to cover various modifications and equivalent arrangements included within the spirit and scope of the appended claims.

As mentioned above, according to the present invention, it is possible to perform the zero-voltage switching in spite of the parasitic components of the circuit and to prevent the generation of the rush current when the sustain discharge operation starts.

What is claimed is:

1. An apparatus for driving a plasma display panel having a plurality of scan electrodes and sustain electrodes arranged in a zigzag pattern so as to make pairs with each other and having a panel capacitor between the scan electrodes and the sustain electrodes, the apparatus comprising:

a sustain discharge unit having first and second switches serially connected between a first voltage and a second voltage and having a contact point of the first and second switches coupled to one end of the panel capacitor and third and fourth switches serially connected between the first voltage and the second voltage and having a contact point of the third and fourth switches coupled to the other end of the panel capacitor, the sustain discharge unit maintaining a voltage of a terminal of the panel capacitor at the first voltage or the second voltage;

a first charge and discharge unit having first and second capacitors serially connected between the first voltage and the second voltage and a first inductor coupled to a contact point of the first and second capacitors and one end of the panel capacitor, the first charge and discharge unit charging one end of the panel capacitor to the first voltage or discharging it to the second voltage; and a second charge and discharge unit having third and fourth capacitors serially connected between the first voltage and the second voltage and a second inductor coupled to a contact point of the third and fourth capacitors and other end of the panel capacitor, the second charge and discharge unit charging the other end of the panel capacitor to the first voltage or discharging it to the second voltage.

2. The apparatus of claim 1, wherein the first charge and discharge unit further comprises a fifth switch for switching current path between the first inductor and the panel capacitor;

and wherein the second charge and discharge unit further comprises a sixth switch for switching current path between the second inductor and the panel capacitor.

3. The apparatus of claim 2, wherein the fifth switch is turned off in a reset period, an addressing period, and an erase period, and maintains voltages charged to the first and second capacitors;

and wherein the sixth switch is turned off in the reset period, the addressing period, and the erase period, and maintains voltages charged in the third and fourth capacitors.

4. The apparatus of claim 3, wherein the fifth switch is a first back-to-back switch formed of a pair of transistors, each having a diode such that two diodes are arranged to be opposite to each other in polarity;

and wherein the sixth switch is a second back-to-back switch formed of a pair of second transistors, each having a diode such that two diodes are arranged to be opposite to each other in polarity.

5. A method for driving a plasma display panel of the apparatus of claim 2, comprising:

turning on the second and fourth switches, to thus maintain voltages of one end and the other end of a panel capacitor at a second voltage;

turning on the fifth switch and turning off the second switch, to thus increase the voltage of one end of the panel capacitor to the first voltage;

turning on the first switch when the voltage of one end of the panel capacitor increases to the first voltage, to thus maintain the voltages of one end and the other end of the panel capacitor at the first voltage and the second voltage, respectively;

turning off the first switch, to thus decrease the voltage of one end of the panel capacitor to the second voltage; and turning on the second switch when the voltage of one end of the panel capacitor reaches to the second voltage, to thus maintain the voltage of one end of the panel capacitor at the second voltage.

6. The method of claim 5, further comprising turning off the fifth and sixth switches in the reset period, the addressing period, and the erase period, to thus maintain the charged voltages of the first through fourth capacitors.

7. The method of claim 5, wherein the first voltage is the sustain discharge voltage and the second voltage is the ground voltage.

8. The apparatus of claim 1, wherein the first through fourth switches are transistors, each of which has a body diode.

9. The apparatus of claim 1, wherein the first voltage is a sustain discharge voltage and the second voltage is a ground voltage.

10. A plasma display panel comprising:

a panel having a plurality of address electrodes and a plurality of scan electrodes and sustain electrodes crossing the address electrodes and making pairs with each other to be arranged in a zigzag pattern and having a panel capacitor between the scan electrodes and the sustain electrodes;

a controller for receiving a video signal from the outside and generating an address drive control signal and a sustain discharge signal;

an address driver for receiving the address drive control signal from the controller and applying a display data signal for selecting discharge cells to be displayed to the address electrodes; and a scan and sustain driver for receiving the sustain discharge signal from the controller and alternately inputting a sustain discharge voltage to the scan electrodes and the sustain electrodes, to thus perform sustain discharge the selected discharge cells, wherein the scan and sustain driver includes:

a sustain discharge unit having: first and second switches serially connected between a first voltage and a second voltage and having a contact point of the first and second switches coupled to one end of the panel capacitor; and third and fourth switches serially connected between the first voltage and the second voltage and having a contact point of the third and fourth switches coupled to the other end of the panel capacitor, the sustain discharge unit maintaining a voltage of a terminal of the panel capacitor at the first voltage or the second voltage;

a first charge and discharge unit having first and second capacitors serially connected between the first voltage and the second voltage and a first inductor coupled to a contact point of the first and second capacitors and one end of the panel capacitor, the first charge and discharge unit charging one end of the panel capacitor to the first voltage or discharging it to the second voltage; and a second charge and discharge unit having third and fourth capacitors serially connected between the first voltage and the second voltage and a second inductor coupled to a contact point of the third and fourth capacitors and the other end of the panel capacitor, the second charge and discharge unit charging the other end of the panel capacitor to the first voltage or discharging it to the second voltage.

11. The plasma display panel of claim 10, wherein the first charge and discharge unit further comprises a fifth switch for switching current path between the first inductor and the panel capacitor, and wherein the second charge and discharge unit further comprises a sixth switch for switching current path between the second inductor and the panel capacitor.

12. The plasma display panel of claim 11, wherein the fifth switch is turned off in a reset period, an addressing period, and an erase period, and maintains the voltages charged to the first and second capacitors;

and wherein the sixth switch is turned off in the reset period, the addressing period, and the erase period, and maintains the voltage charged to the third and fourth capacitors.

13. The plasma display panel of claim 10, wherein the first voltage is a sustain discharge voltage and the second voltage is a ground voltage.

* * * * *